United States Patent [19]

Hellgren et al.

[11] 4,120,333

[45] Oct. 17, 1978

[54] METHOD AND APPARATUS FOR TRIMMING TIMBER

[75] Inventors: Hans Arthur Hellgren; Karl Georg Erhard Marklund, both of Skellefteå, Sweden

[73] Assignee: Renholmens Mekaniska Verkstad AB, Byske, Sweden

[21] Appl. No.: 680,802

[22] Filed: Apr. 27, 1976

[30] Foreign Application Priority Data

Apr. 28, 1975 [SE] Sweden ..... 7504907

[51] Int. Cl.[2] ..... B27B 1/00; B27B 31/04

[52] U.S. Cl. ..... 144/312; 83/522; 144/3 R; 144/242 R; 144/242 G; 144/246 R; 144/326 R; 198/403

[58] Field of Search ..... 198/403, 434, 456; 83/284, 365, 522; 144/2 R, 3 R, 242 R, 242 D, 242 H, 245 R, 245 A, 245 D, 309 R, 312, 323, 326 R

[56] References Cited

U.S. PATENT DOCUMENTS

| | | | |
|---|---|---|---|
| 2,938,552 | 5/1960 | Rogers | 144/3 R |
| 3,247,963 | 4/1966 | Fehely | 198/434 X |
| 3,565,140 | 2/1971 | Jacobsen | 144/242 R |
| 3,948,385 | 4/1976 | Shinomiya | 198/403 |
| 4,023,605 | 5/1977 | Hellstrom et al. | 144/312 |

*Primary Examiner*—Othell M. Simpson
*Assistant Examiner*—W. D. Bray
*Attorney, Agent, or Firm*—Burns, Doane, Swecker & Mathis

[57] ABSTRACT

In a method of trimming timber pieces, in which the pieces are cross-cut at one end and thereafter are advanced to a turner, the invention includes the step of applying to each piece, prior to arrival at the turner, a plurality of marks which are registrable after the turning of the piece. The marks are applied on that side of the piece which, after the turning, shall face upwardly. Preferably, the marks are equally spaced, and are repeated from the cross-cut end to the opposite end of the piece.

5 Claims, 6 Drawing Figures

METHOD AND APPARATUS FOR TRIMMING TIMBER

Figure 1:
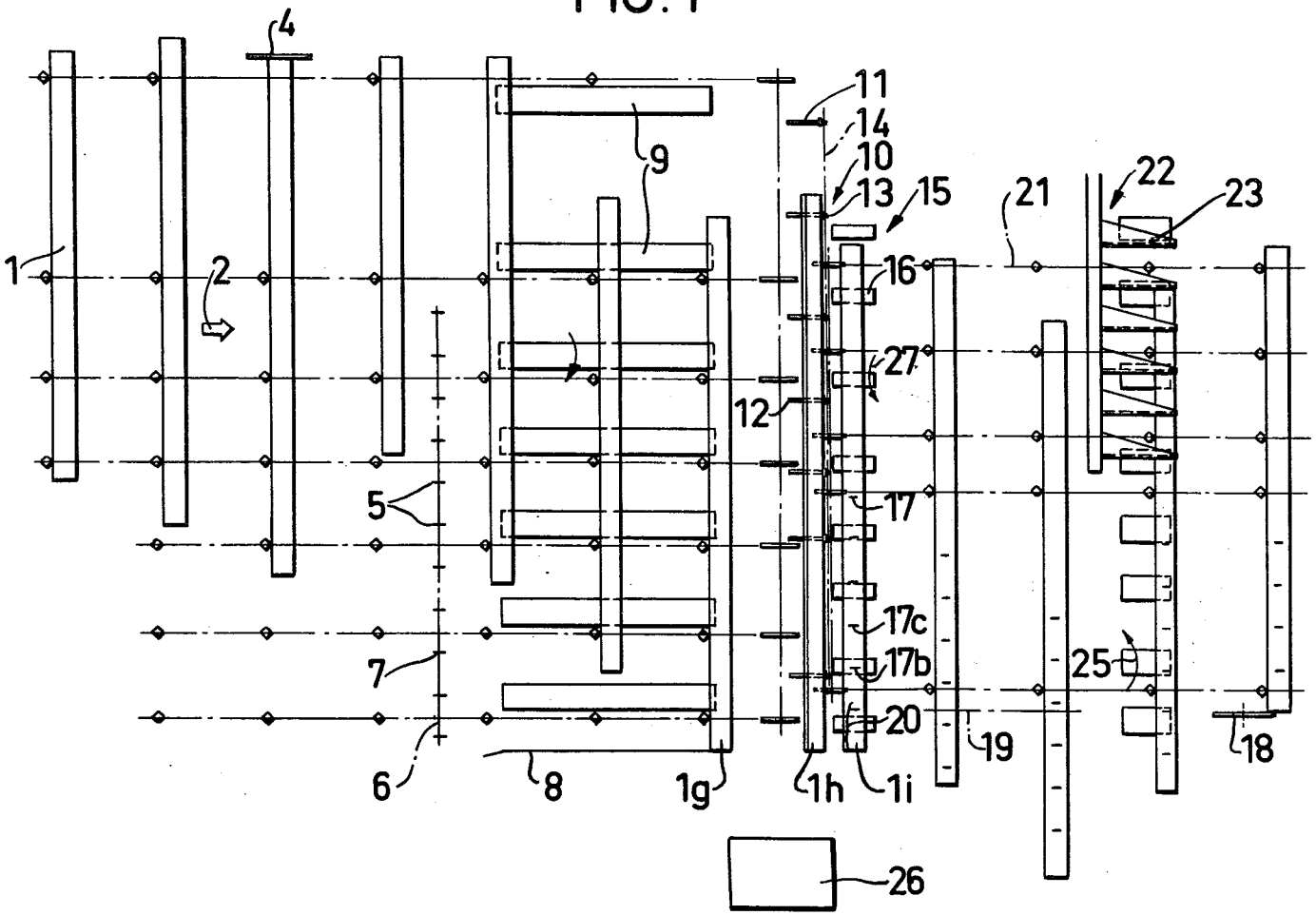

This invention relates to a method of trimming timber pieces preferably cross-cut, which are advanced, one at a time, to a board turner and after being turned are further advanced perpendicularly to their longitudinal direction toward and through a trimming saw where they are cross-cut to correct length. The invention relates also to an apparatus for carrying out the method.

In the trimming of timber, as known, the timber pieces are first cross-cut at one end, whereafter a determination of the grade and therewith a sorting by grade take place, and finally the timber pieces are cross-cut at their other end to their intended length and quality. This is carried out, as known, in a trimming plant or on trimming tables which are provided with a board turner for turning the ingoing timber pieces, which are finely adjusted at one end and end-aligned at their other end, and a trimming saw, to and through which the timber pieces thus turned are fed perpendicularly to their longitudinal direction by means of a carrier conveyor and are cross-cut to correct length. Before the timber pieces are advanced through the trimming saw, however, in the known trimming installations the trimmer must manually adjust the timber pieces to length i.e. manually set the length, to which each timber piece is to be cross-cut. This adjusting to length is carried out in such a manner that, after the timber pieces have been turned and placed on a roller stand provided after the board turner and perpendicularly to the feed direction of the timber pieces, the trimmer manually pulls toward himself each turned timber piece, so that its end portion, which is damaged or defective in some other way, will be located with a certain margin outside the so-called sawing line, i.e. outside an imagined line in the extension of the trimming saw. The trimmer then pushes back the timber piece against the first measurement finger of a bank of such fingers comprising a plurality of such measurement fingers equally spaced one after the other in the longitudinal direction of the timber piece, and is disposed in connection with the roller stand. In said measurement stand the length is set to which the timber piece is to be cross-cut by the trimming saw.

This manual length adjustment of the timber pieces in known trimming installations, however, has proved to involve certain problems. It was found that it gradually can give rise to injuries of the back and shoulders of the trimmer, supposingly due to the stresses and above all the jerks and recoils to which the trimmer is exposed each time he pushes a timber piece against a measurement finger. Another essential disadvantage in this connection is the way in which the adjustment work in the known trimming installations is carried out. The trimmer must carry out a concentration of several specific functions, which directly reduces his capacity and according to opinion causes stress just because the trimmer must concentrate on several functions simultaneously. The trimmer must all the time direct his attention to the timber piece being advanced to the board turner as well as to the timber piece which, after having passed the board turner, lies on the roller stand, and he must determine its grade and rapidly decide the size of the portion of be cut off. Simultaneously, the trimmer must manually adjust the length of the timber piece lying on the roller stand, which requires high precision in order to avoid unnecessary timber losses.

The present invention has the object of bringing about a method of and an apparatus for trimming timber which to the greatest possible extent eliminate the aforesaid disadvantages and thereby improve the working environment for the trimmer and at the same time render possible a high through-feed speed, i.e. capacity, as well as an optimum utilization of timber within the set limits.

This object is achieved in that that the method and apparatus according to the invention have been given the characterizing features defined in the claims. According to the main claim, it is one basic feature of the invention that a plurality of marks are applied on each timber piece along its entire length to that end which has not yet been trimmed, which marks are registrable at least after the turning of the timber piece. The marks are placed equally spaced at a distance from the finely adjusted end which is a multiple of the spacing between the marks. This application of marks according to the invention renders it possible to very substantially simplify and automate the trimming work in many different ways, which are described in the following, and it eliminates entirely the manual work of pushing the timber pieces against the measurement finger.

Figure 2:
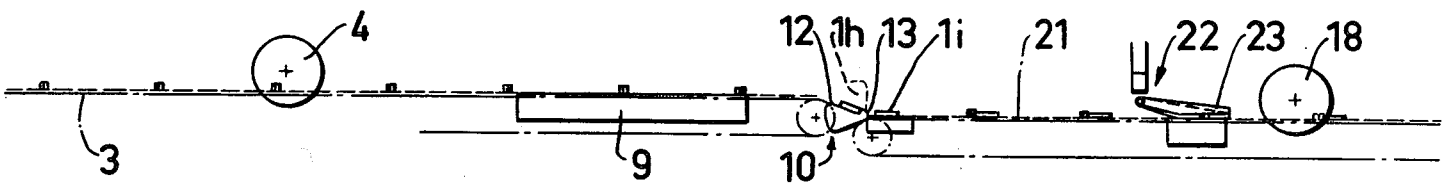
Figure 3:
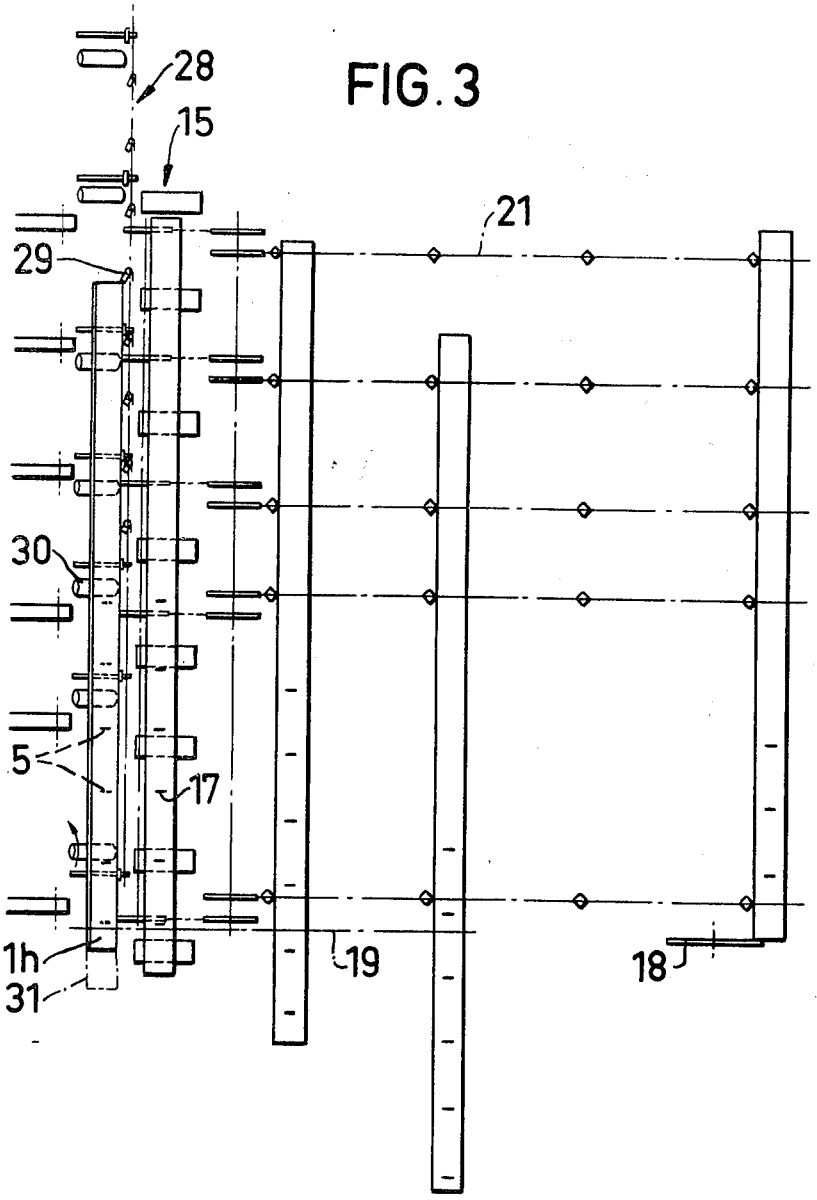
Figure 4:
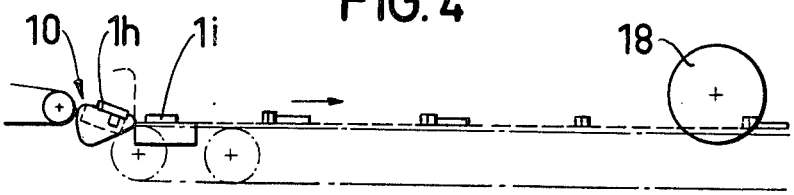
Figure 5:
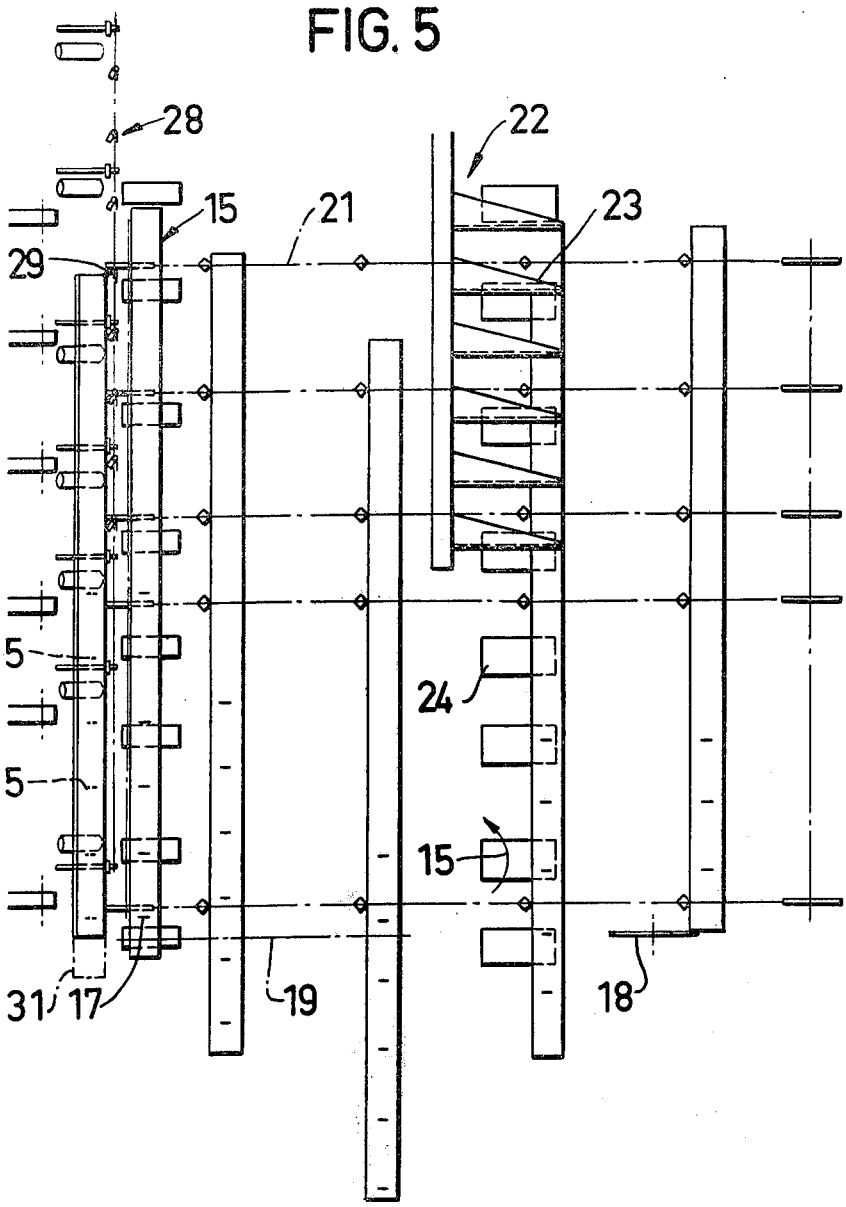
Figure 6:
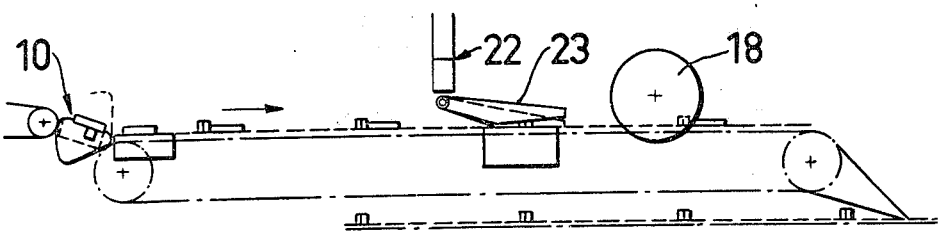

The invention is described in greater detail in the following and, with reference to the accompanying drawings, in which FIG. 1 is a horizontal view, and FIG. 2 is a lateral view of a first embodiment of the apparatus for carrying out the method according to the invention;

FIGS. 3 and 4 are a horizontal view and, respectively, a lateral view of a second embodiment of the invention; and FIGS. 5 and 6 are a horizontal view and, respectively, a lateral view of a somewhat modified embodiment of the apparatus shown in FIGS. 3 and 4.

The method according to the invention is based on the feature that a plurality of marks, which are registrable at least after the turning of the timber piece, are applied along the length of each timber piece to be trimmed in the direction and all the way to its not yet trimmed end. The marks, in other words, are to be placed on that side of the timber pieces which, after the turning in a turner, faces upward. The marks, according to the invention, further are to be equally spaced relative to each other and placed at a distance from the trimmed end which is a multiple of the spacing between the marks. The spacing between the marks is chosen in agreement with the modular length system, according to which the timber pieces are to be cross-cut and, as a rule, each such module corresponds to a distance of 3 dm. Also other modules, of course, can be used, but in the following the base of the modular system is assumed to be 3 and, therewith, also the spacing between the marks is to be 3 dm. The marks can be of any type adapted for mechanical and/or manual registration at least during a certain time after the application and may, for example, be strokes or points of some colour, graphite or some other applicable material. Also marks in the form of applicable pins, clips or the like can be employed.

The marks according to the invention can be applied substantially at any time after the root end of the timber pieces has been cut off but before the pieces are turned. In FIGS. 1 and 2 an embodiment of an apparatus for carrying out the method is shown, in which the marks are applied in connection to, or more correctly, immediately after the timber pieces have passed a root cutter, by which the timber pieces are finely adjusted at one end. In FIG. 1 as well as in the remaining figures the timber pieces are designated by the numeral 1 and, to the necessary extent, by 1*a–n* beginning from the left-hand side of the figures. The timber pieces 1 are advanced, perpendicularly to their longitudinal direction, in the direction indicated by the arrow 2, by means of a carrier conveyor 3 feeding the timber pieces 1 through a cross-cut saw 4 where parts of poor quality at one end of the timber pieces are removed. During their continued feed, the timber pieces pass over mark applicators 5 which provide the pieces with marks at least at their end not yet trimmed. The mark applicators 5 are arranged equally spaced relative to each other, their spacing corresponding to the base module in the modular system, according to which the timber pieces are cross-cut, and they are so positioned that their distance to a vertical plane through the cross-cut saw 4 is a multiple of the spacing between the applicators. Hereby the marks applied on the timber pieces will have a distance to the trimmed end which is a multiple of the spacing between the marks.

The applicators 5 shown in FIG. 1 by way of example comprise ink-rollers 7 on a common axle 6 which at the passage of the timber pieces automatically apply marks on the lower sides of the pieces. It is to be observed in this connection, that the invention is not restricted to ink-rollers, but each other type of applicator is comprised by the invention.

After the application of the marks, the timber pieces at their end not yet trimmed are end-aligned against a plate 8 by means of a roller stand with driven rollers 9. Such an end-aligned timber piece is in FIG. 1 designated by 1*g*. After their end-alignment, the timber pieces are fed into a board turner generally designated by 10. The board turner 10 comprises a plurality of transversely spaced interconnected members 11 having surfaces 12, lying in one plane, for supporting the timber piece placed in the board turner and stop means 13 located perpendicularly to said surfaces 12 and in alignment with each other for stopping a timber piece entering the board turner. The board turner 10, furthermore, is pivotal about an axle 14 for turning one timber piece at a time and positioning it on a transverse conveyor 15 subsequent to the board turner. The conveyor is shown in the form of a roller stand with rollers 16. The rollers can be nondriven or driven intermittently, and the transverse conveyor 15 may also be a belt conveyor or like arrangement, which renders it possible to move the timber pieces in their longitudinal direction, i.e. perpendicularly to the normal feed direction of the timber pieces through the apparatus.

As the timber pieces are being turned, thus, the marks applied by the applicators 5 become visible and registrable for the trimmer. A timber piece thus turned is designated by 1*i*, and it shows a plurality of marks, by which the trimmer quickly can decide the distance through which the timber piece must be moved in its longitudinal direction in relation to the sawing line, which is an imaginary line 19 in the extension of the trimming saw 18, in order to ensure that the damaged or poor-quality end portion of the timber piece will be cut off by the trimming saw 18.

During the feed of a timber piece to the board turner 10 and during its turning in said turner, the trimmer has good time to observe and inspect the surface of the timber piece which faces upwards before the turnover of said piece and to decide the size of the portion to be cut off from the timber piece because of the damages visible on said surface. The location of the cutting is then, during the turnover of said piece, transferred by eye (virtually) to the surface of said piece which faces upwards after the turnover action, said transfer being essentially facilitated by the marks 17 visible after tue turnover of the piece. Now, the trimmer inspects the surface of the piece having said marks 17, which then make it possible for the trimmer to rapidly decide where the timber piece is to be cross-cut by the trimming saw 18. It is assumed, as an example, that the timber piece 1*i* lying on the transverse conveyor 15 and having been turned has a crack 20 with the extension shown, and that a previous inspection of the timber piece had shown that the piece can be cross-cut somewhat inside of the end of the crack 20. This implies, according to the embodiment shown in FIGS. 1 and 2, that the timber piece 11 is to be moved in its longitudinal direction through such a distance that the sawing line 19, which can be marked in some suitable way, will be located between the two first marks 17 after the crack 20, i.e. the marks 17*b* and 17*c* on the timber piece 1*i* in FIG. 1. After its movement in its longitudinal direction through this distance which movement could be affected manually by the trimmer or by the driven rollers 16", the timber piece is advanced further by means of a carrier conveyor 21 perpendicularly to its longitudinal direction through a a bank 22 of measurement fingers 23 where the length to which the timber pieces are to be cross-cut by means of the cross-cut saw 18 is set finally. The measurement fingers 23 are spaced relative to each other at a spacing corresponding to the spacing between the marks 17 and are positioned at a distance from the sawing line 19 constituting a multiple of the spacing between the measurement fingers, and thus also between the marks 17.

In connection to the bank 22 of measurement fingers, furthermore, a roller conveyor having rollers 24 is provided which are driven in the direction indicated by the arrow 25. When, a timber piece is advanced into the bank 22 of said fingers, and of the fingers 23 situated above said piece in the bank 22, are lifted by the piece itself and, thus, when the piece is advanced over the rollers 24, the rollers automatically effect a displacement of the timber piece so that the trimmed end of the piece is into contact with the first measurement finger, which has not been lifted by the timber piece. By this displacement the mark located closest to the damaged portion and at which the cutting is decided to be made will be positioned in registry with the sawing line, and the timber piece then is cross-cut at this mark.

The movement of the timber pieces on the transverse conveyor 15 can take place either manually, or the transverse conveyor as already mentioned can be driven intermittently and be operated from a control station 26, which can be equipped with control means for stopping and starting the transverse conveyor 15, or with a set of buttons with numbered keys, for example from 1 to 10, for controlling the transverse conveyor and, thereby, for moving each turned timber piece through the necessary distance. When such a button set is used for effecting the movement of the timber piece 1*i*, the button with the number two is depressed. This implies that the conveyor is started and operated in the direction indicated by the arrow 27 until the second mark 17*b* has passed the sawing line 19. This is registered by a means (not shown), which with some delay causes the conveyor so to stop that the timber piece 1*i* stops and the sawing line 19 is located between the marks 17*b* and 17*c*. Also other control means and systems for operating the transverse conveyor 15 can be used.

The embodiment shown in FIGS. 3 and 4 differs from the one just described in that the mark applicators 5 are provided in the board turner 10 in such a manner that one of the applicators 5 aligns with the sawing line 19. In order to correctly place the marks on the lower surface of the timber piece 1*h* lying in the board turner, in connection to the board turner a bank 28 of multiple measurement fingers 29 is provided, which extend into the board turner so as to constitute stop members for the abutment of the trimmed end of the timber piece located in the board turner. This abutting takes place automatically by means of driven rollers 30 provided in the board turner. The space between the measurement fingers 29 is the same as the spacing between the applicators 5, and the distance from each measurement finger 29 to the sawing line 19 is a multiple of the spacing between the applicators as well as the measurement fingers.

In FIGS. 3 and 4 a timber piece 1*h* is shown in the board turner 10, which piece has been moved by the rollers 30 from its position where it has entered the board turner. This position, for reason of better clearness, has been indicated in FIG. 3 by dash-dotted lines 31. The timber piece has been end-aligned against a measurement finger 29, i.e. each ingoing timber piece is end-aligned automatically by the rollers 30 against the measurement finger, which in the aligning direction is located closest before the adjusted end of the ingoing timber piece. The adjusted end of the timber piece by said end-alignment is given a definite position in relation to the sawing line 19 and also to the applicators 12. Thereby also the marks applied by the applicators will have an accurate predetermined distance to the adjusted end of the timber piece. After the end-alignment of the timber piece 1*h* against said measurement finger 29, the applicators 5 automatically are initiated to mark the timber-piece in the board turner 10, and after the marking the board turner 10 is automatically pivoted about its axle 14 for turning the timber piece thus marked and to position it on the transverse conveyor 15, whereby the applied marks 17 become visible to the trimmer. In this case, in which the applicators 5 and the measurement fingers 29 of the bank 28 are arranged so-to-say in phase with the saw line 19, one of the marks 17 of the turned timber piece will lie directly before the measurement line. The turned timber piece is intended to be moved through such a distance that the first mark 17 after the damage—or that part of the end portion which the trimmer has decided to be cut off—will be located directly before the sawing line 19. After this movement the timber piece is advanced further by the carrier conveyor 21 to the cross-cut saw 18. As the mark, directly in front of which the cross-cutting is to take place, already lies in the sawing line, the measurement stand 22 shown in FIGS. 1 and 2 is not required.

In FIGS. 5 and 6 an embodiment is shown which differs from that shown in FIGS. 3 and 4 only in, that the applicators 5 and the measurement fingers 29 in the bank 28 located in connection with the board turner 10 are phase-shifted relative to the saw line 19, and thereby that the same bank as in the embodiment according to FIGS. 1 and 2 is provided, in which the measurement fingers 23 are phase-shifted as much in relation to the sawing line 19 as the applicators 5 and measurement fingers 29, but in the opposite direction. In this case, thus, as in the embodiment according to FIGS. 1 and 2, the timber pieces after the turning are to be moved such a distance that the sawing line 19 will be located between the two first marks after the damage or after that part of the end portion of the timber piece which the trimmer has decided to be removed. Thereafter the bank 22 automatically attends to the positioning of the timber piece so that the mark closest to the damage will be located directly in front of the cross-cut saw 18. The timber piece thereby is cross-cut to correct length according to the modular system applied and in the present case is given a length divisible through 3, because the base module was assumed to be 3 dm. By changing thhe spacing between the measurement fingers of the different banks and between the applicators, however, any base module can be utilized.

The present invention is not restricted to the embodiments described above and shown in the drawings, but can be altered and modified in many different ways within the scope of the claims. The invention, furthermore, comprises also different combinations of the embodiments shown and described, and even marks can be used which of their own disappear after some time.

What we claim is:

1. In a method of trimming timber pieces moving at spaced intervals and perpendicularly to their longitudinal direction to facilitate length and quality determination of said pieces in order to obtain optimal yield from each timber piece, comprising the steps of:

(a) trimming first ends of said pieces during said movement;

(b) advancing said pieces to a turnover mechanism;

(c) applying on the lower surface of each one of said timber pieces a plurality of marks equally spaced relative to each other over a substantial length of each piece incorporating the second transverse end thereof, each one of said marks being located at a distance from said first trimmed end which is a multiple of the spacing between the marks;

(d) turning said piece in said turnover mechanism to make said marks visible from above said piece, inspecting all of the piece surfaces so as to properly grade the piece and then selecting that mark at which said piece is to be trimmed off;

(e) positioning said selected mark in registry with a saw line parallel with the advancing direction of the pieces for a second trimming saw, by moving said piece in its longitudinal direction; and (f) advancing said piece to said second trimming saw to cut off the piece at the selected mark.

2. The method defined in claim 1, wherein said marks are applied during the advancing movement of the timber pieces to said turnover mechanism.

3. An apparatus for trimming timber pieces of random lengths to modular lengths determined under consideration of quality to obtain optimal yield from each timber piece, said apparatus comprising a conveyor means for advancing said pieces perpendicularly to the longitudinal direction thereof and at spaced intervals;

a first saw means located at one side of the conveyor means for trimming first ends of the pieces in a plane parallel with the advancing direction;

an applicator device for applying a plurality of marks on the lower side of each timber piece, said applicator device comprising a plurality of marking means located in an equally spaced relation transversely of said conveying direction, each one of said marking means being located at a predetermined distance from a reference line;

a turnover mechanism located in a predetermined location on said conveyor means for turning said pieces to make the marks applied on the pieces visible from above whereby all of the piece surfaces may be inspected for proper grading and selection of a mark at which said piece is to be trimmed off;

means for moving said turned piece in its longitudinal direction to position said selected mark in registry with a saw line parallel with the advancing direction of the pieces and located at the other side of said conveyor means; and a second saw means located in said saw line for cutting said pieces at said selected marks.

4. An apparatus according to claim 3, wherein said applicator device has its marking means arranged in a transverse row extending at a right angle to a vertical plane through said second saw means at said other side of the conveyor means, said plane being outside of said saw line of the second saw means at a predetermined distance, and including means for aligning a second end of each piece on the conveyor means comprising an end-engaging plate located in said vertical plane.

5. An apparatus according to claim 4, wherein said applicator device is located downstream from the first saw means and upstream from said aligning means.

* * * * *